US010342403B2

(12) United States Patent
Fard Rahmani

(10) Patent No.: US 10,342,403 B2
(45) Date of Patent: Jul. 9, 2019

(54) ELECTRICITY PRODUCING FLEXIBLE AND SLIM NOZZLE FOR BEING RELEASABLY CONNECTED TO A SUCTION SOURCE OF A VACUUM CLEANER

(71) Applicant: Apiros AB, Trångsund (SE)

(72) Inventor: Arash Fard Rahmani, Trångsund (SE)

(73) Assignee: APIROS AB, Trångsund (SE)

( * ) Notice: Subject to any disclaimer, the term of this patent is extended or adjusted under 35 U.S.C. 154(b) by 0 days.

(21) Appl. No.: 15/964,126

(22) Filed: Apr. 27, 2018

(65) Prior Publication Data

US 2018/0242802 A1 Aug. 30, 2018

Related U.S. Application Data

(63) Continuation of application No. PCT/SE2016/051058, filed on Oct. 28, 2016.

(30) Foreign Application Priority Data

Oct. 29, 2015 (SE) ..... 1551393

(51) Int. Cl.
*A47L 9/02* (2006.01)
*A47L 9/28* (2006.01)
*A47L 9/30* (2006.01)

(52) U.S. Cl.
CPC ..... *A47L 9/02* (2013.01); *A47L 9/2857* (2013.01); *A47L 9/2868* (2013.01); *A47L 9/30* (2013.01)

(58) Field of Classification Search
USPC ..... 15/415.1, 339, 363, 412
See application file for complete search history.

(56) References Cited

U.S. PATENT DOCUMENTS

| | | | | |
|---|---|---|---|---|
| 2,915,774 | A * | 12/1959 | Darrow | A47L 9/0411 15/324 |
| 8,214,968 | B2 * | 7/2012 | Griffith | A47L 9/0416 15/321 |
| 2010/0313379 | A1 * | 12/2010 | Milanese | A47L 9/0411 15/339 |
| 2012/0272473 | A1 | 11/2012 | Griffith | |
| 2016/0088987 | A1 * | 3/2016 | Hwang | A47L 9/0054 15/415.1 |

FOREIGN PATENT DOCUMENTS

| | | | |
|---|---|---|---|
| EP | 2243414 | A2 | 10/2010 |
| KR | 20040047368 | A | 6/2004 |
| WO | 2009078050 | A1 | 6/2009 |
| WO | 2015049011 | A1 | 4/2015 |

* cited by examiner

*Primary Examiner* — Joseph J Hail
*Assistant Examiner* — Shantese L McDonald
(74) *Attorney, Agent, or Firm* — Gabriela B. Tomescu, Esq.; Bergenstråhle & Partners AB

(57) ABSTRACT

The present invention relates to a nozzle suitable for being releasably connected to a suction source of a vacuum cleaner. The nozzle comprises a nozzle tube, a slim nozzle head, a flexible joint configured to provide a freedom of movement, a flexible conduit, a light source, and a power generation device.

18 Claims, 4 Drawing Sheets

ELECTRICITY PRODUCING FLEXIBLE AND SLIM NOZZLE FOR BEING RELEASABLY CONNECTED TO A SUCTION SOURCE OF A VACUUM CLEANER

This application is the continuation of International Application No. PCT/SE2016/051058, filed 28 Oct., 2016, which claims the benefit of Swedish Patent Application No. SE 1551393-0, filed 29 Oct., 2015, the entire contents of which are hereby incorporated by reference.

TECHNICAL FIELD

The present invention relates to a nozzle suitable for being releasably connected to a suction source of a vacuum cleaner. The nozzle comprises a nozzle tube, a slim nozzle head, a flexible joint configured to provide a freedom of movement, a flexible conduit, a light source, and a power generation device.

BACKGROUND OF THE INVENTION

WO2009/078050 relates to a nozzle (brush) for a vacuum cleaner, with an integrated UVC germicide lamp that works without being connected to an external electric power supply because the current generator necessary for its powering is part of the nozzle itself. The UVC germicide lamps gives out a light with a wave length of 253,70 nm and is named "germicide" for its capability to neutralize bacteria. As illustrated in FIG. 4 the air sucked by the motor fan inside the vacuum cleaner, connected to the brush through the pipe union (4), enters the brush through the suction inlet (5). Through the internal structure of the brush the air is conveyed to the fan (2) that, due to this forced air flow rotates at high speed, and then goes out of the pipe union towards the vacuum cleaner appliance. The fan (2) is connected, through a timing belt (7) to a synchronous motor or a dynamo (8), that rotating, creates electric current at a certain voltage. One of the disadvantages with this type of nozzle (brush) is that dust, dirt, hair, string, lacing, twine, cords and yarn which is sucked from the surface to be cleaned enters the suction inlet (5) and then gets tangled in the fan (2) thereby obstructing the fan from rotating. The obstruction not only lowers the efficiency of electricity generation, but leads eventually to the complete failure of the fan and total stop of electricity generation. Moreover, once the fan is partially or completely obstructed from rotating, dirt and dust then clog up the space between the fan and the fan housing which leads to further obstruction of the fan as well as the nozzle being clogged by dust and dirt. Clumps of dust, i.e. dust bunnies, are especially responsible for the failure of the fan as well as the clogging of the nozzle. Dust bunnies are made of hair, lint, dead skin, spider webs, dust, and sometimes light rubbish and debris, and are held together by static electricity and felt-like entanglement. They can also house dust mites or other parasites, and can drastically lower the efficiency of the fan.

A further disadvantage of the nozzle (brush) in WO2009/078050 is that it is impossible for the operator to remove obstructions from the fan since as illustrated in FIGS. 3 the underside of the nozzle (brush) is covered with one or more plates which must be removed (or unscrewed) with at least one tool. Such tools might be not be available to the operator, or that the operator does not have knowledge in opening up and repairing nozzles. Moreover, it also appears from the illustration in FIG. 4 that the fan is placed in a fan housing which is inaccessible to the operator even if the plate(s) could be removed from the underside of the brush. Hence, the operator must leave the nozzle to an authorized repair person which generates unnecessary costs and time loss for the operator.

A further disadvantage with the nozzle in WO2009/078050 is that the freedom of rotation of the nozzle relative to the pipe union (4) is restricted. FIGS. 1-4 clearly illustrate that the joint between the nozzle and pipe union (tube) is the type of joint which only allows a circular movement for the pipe union. This type of joint is the standard type of joint used in most vacuum cleaners and which enables an operator to move the nozzle towards or away from the operator. Additionally, when an operator is cleaning the surface underneath a narrow (low) space such as a bed, then the operator can't perform the circular movement to move the nozzle head left or right since the pipe union collides with the underside of the bed. Instead, the operator has to use muscle strength and body movement to sweep the nozzle left and right underneath the bed; this is as disadvantage since it is (a) strenuous for operators which lack muscle strength or are obstructed from using their bodies fully, and (ii) inefficient use of energy, (iii) tiring if there are many areas in narrow spaces. Hence, the joint and the nozzle in the vacuum cleaning system disclosed in WO2009/078050 does not provide an ergonomical working experience for the operator and thereby leading to discomfort and fatigue. In operators who work as professional vacuum cleaning operators, the system disclosed in WO2009/078050 may lead to repetitive strain injury (RSI) as well as injuries to the operator's joints and muscles.

A further disadvantage with the nozzle in WO2009/078050 is that the nozzle is too high as illustrated in FIG. 4 and can't therefore be used for reaching areas in narrow spaces. Yet a further disadvantage is that it is not possible to disconnect the nozzle in WO2009/078050 from the pipe union in order to connect it to another pipe union, i.e. the nozzle is permanently attached to the pipe union.

Hence, there is a need to eliminate the disadvantages with the nozzle disclosed in WO2009/078050.

OBJECT OF THE INVENTION

There is a complex of problems associated with the nozzles described in prior art documents. The aim of the present invention is to eliminate said complex of problems.

The object of the present invention is to provide a nozzle wherein the power generation device is not obstructed by dust, dirt, soil, stone, dust bunnies, hair, string, thread, lacing, twine, cords and yarn.

A further object of the present invention is to provide a nozzle wherein it is easy to remove obstructions.

A further object of the present invention is to provide a nozzle wherein there is a high freedom of movement of the nozzle relative to the suction source (i.e. extension tube, pipe union or hose).

A further object of the invention is to provide is to provide a nozzle which can be used for reaching areas in narrow (low) spaces.

A further object of the invention is to provide an ergonomical nozzle which maximizes cleaning productivity by reducing fatigue and discomfort.

A further object of the invention is to provide an ergonomical nozzle which minimizes the risk of repetitive strain injury (RSI) as well as injuries to the operator's joints and muscles.

A further object of the invention is to provide a nozzle which can be releasably attached to any suction source (i.e. extension tube, pipe union or hose).

SUMMARY OF THE INVENTION

The object of the invention is attained by the nozzle disclosed in the claims.

A nozzle according to a preferred embodiment of the present invention is suitable for being releasably connected to a suction source of a vacuum cleaner and comprises:

- a nozzle tube having an upper opening, and a lower opening, the upper opening being configured to be connected to a suction source of a vacuum cleaner,
- a side opening being attached to an outward projecting tube, wherein the side opening 3 and the outward projecting tube 5 are arranged on the nozzle tube 1 or on the topside 8 of the nozzle head 6,
- a slim nozzle head, wherein the height of the nozzle head is 9 mm up to 45 mm, and wherein the nozzle head 6 has an underside 7, topside 8, frontside 9 and backside 10,
- a flexible joint connected both to the nozzle head and the lower opening of the nozzle tube, wherein the flexible joint is configured to provide a freedom of movement, wherein said freedom of movement is a movement in the direction of (i) upwards, (ii) downwards, (iii) leftwards, (iv) rightwards, and (v) upwards or downwards in combination with leftwards or rightwards,
- a conduit connected both to the outlet of the nozzle head and the lower opening of the nozzle tube,
- a light source having one or more lamps positioned on the nozzle head and configured to project light to illuminate the surface to be cleaned, and
- a power generation device mounted in the outward projecting tube, the power generation device being configured to generate electrical current from the sucked air flow, the power generation device being electrically connected with the light source by an electrical wire, and the light source being powered by the electrical current generated by the power generation device.

A further preferred embodiment of the present invention relates to said nozzle, wherein the side opening and the outward projecting tube are arranged on the nozzle tube 1, preferably the side opening and the outward projecting tube are arranged at any point in the axial and circumferential directions of the nozzle tube.

A further preferred embodiment of the present invention relates to said nozzle, wherein the side opening and the outward projecting tube are arranged on the topside 8 of the nozzle head 6, preferably the side opening and the outward projecting tube are arranged centrally on the nozzle head 6.

A further preferred embodiment of the present invention relates to said nozzle, wherein the nozzle head is triangular, trapezoidal, parallelogram, rectangular, quadratic, pentagonal, hexagonal or octagonal, preferably rectangular.

A further preferred embodiment of the present invention relates to said nozzle, wherein the flexible joint and the conduit are integrated with each other and thus forming one part, the integrated flexible joint and conduit being connected to both to the nozzle head and the lower opening of the nozzle tube, wherein the integrated flexible joint and conduit is configured to be pivotally connected to the nozzle head and providing a pivotal freedom of movement in the (i) upwards and (ii) downwards directions relative to the nozzle head, wherein the flexible joint and conduit is also configured to be pivotally connected to the lower opening of the nozzle tube and providing a pivotal freedom of movement in the (iii) leftwards and (iv) rightwards directions relative to the nozzle head.

A further preferred embodiment of the present invention relates to said nozzle, wherein the conduit is flexible, more preferably the conduit is a hose or a bellow.

A further preferred embodiment of the present invention relates to said nozzle, wherein the outlet extends from the back side of the nozzle head.

A further preferred embodiment of the present invention relates to said nozzle, wherein the outlet is substantially perpendicular to the plane of the back side of the nozzle head.

A further preferred embodiment of the present invention relates to said nozzle, wherein the outlet which has an angle of −10 to 100 degrees relative to the plane of the surface, preferably 0-45 degrees, more preferably 0-20 degrees, even more preferably 0-15 degrees.

A further preferred embodiment of the present invention relates to said nozzle, wherein the back side of the nozzle head further comprises two flanges extending from the back side of the nozzle head, the outlet being placed in between the flanges, and wherein the flexible joint is connected to the flanges.

A further preferred embodiment of the present invention relates to said nozzle, wherein the flanges are substantially perpendicular to the plane of the back side of the nozzle head.

A further preferred embodiment of the present invention relates to said nozzle comprising, wherein the flanges have an angle of −10 to 100 degrees relative to the plane of the surface, preferably 0-45 degrees, more preferably 0-20 degrees, even more preferably 0-15 degrees.

A further preferred embodiment of the present invention relates to said nozzle, wherein the flexible joint comprises two arms connected to each other by two connectors which are also part of the flexible joint, the flexible joint further comprising an aperture configured for allowing the flexible conduit to extend through the flexible joint, and the arms of the flexible joint being pivotably connected to the flanges the two connectors being pivotably connected to the lower opening of the nozzle tube.

A further preferred embodiment of the present invention relates to said nozzle, wherein the power generation device comprises a power generator and fan blades attached to the power generator.

A further preferred embodiment of the present invention relates to said nozzle, wherein the side opening is circular, rectangular, quadratic, or four to ten sided.

A further preferred embodiment of the present invention relates to said nozzle, wherein the outward projection tube is shaped as a cylindrical tube, rectangular tube, quadratic tube or four to ten sided tube.

A further preferred embodiment of the present invention relates to said nozzle, wherein the outward projecting tube is angled 1-179 degrees in relation to the plane of the nozzle tube.

A further preferred embodiment of the present invention relates to said nozzle, wherein the outward projecting tube is angled 1-179 degrees in relation to the plane of the topside of the nozzle head.

A further preferred embodiment of the present invention relates to said nozzle, the outward projecting tube is configured to be on the front side of the nozzle tube and angled at about 90 degrees in relation to the plane of the nozzle tube.

A further preferred embodiment of the present invention relates to said nozzle, the outward projecting tube is configured to be centrally on the topside of the nozzle head, and preferably angled at about 90 degrees in relation to the plane of the nozzle head.

A further preferred embodiment of the present invention relates to said nozzle, comprising a switch for switching off the power generation device.

A further preferred embodiment of the present invention relates to said nozzle, comprising a switch for switching off the power generation device, said switch being a plate configured to slide up or down the opening of the outward projecting tube, alternatively configured to slide left or right, said switch being substantially parallel to the plane of the nozzle tube, wherein the opening of the outward projection tube is in contact with the switch, the switch partially covering the opening of the outward projection tube, wherein the switch is configured to slide in a direction (up, down, left or right) to hinder the suction of air into the power generation device thereby switching the power generation device off.

A further preferred embodiment of the present invention relates to said nozzle, wherein the surface of the switch is covered with a series of parallel riblets extending longitudinally or axially along the surface of the switch, wherein the riblets have a triangular, rectangular, elliptical or circular cross-section in the transverse direction.

A further preferred embodiment of the present invention relates to said nozzle, wherein the opening of the outward projecting tube comprises a plate being smaller than the opening of the outward projecting tube and being configured to be releasably attached to the outward projecting tube.

A further preferred embodiment of the present invention relates to said nozzle, wherein the opening of the outward projecting tube comprises a plate having a diameter smaller than the diameter of the outward projecting tube and being configured to be releasably attached to the outward projecting tube.

A further preferred embodiment of the present invention relates to said nozzle, wherein the underside of the nozzle head comprising one or more suctions holes, recesses and wheels at the underside of the nozzle head, and wherein said underside optionally comprises fabrics, textiles and brushes.

A further preferred embodiment of the present invention relates to said nozzle, wherein the flexible joint 11 (e.g. flanges and/or arms) and/conduit 12 comprise a mechanism activated by the operator and which after activation holds the nozzle tube at angle 45 to 135 degrees in relation to the plane of the surface of the floor, wherein said activation is preferably after finishing the operation of the vacuum cleaner.

A further preferred embodiment of the present invention relates to said nozzle, wherein the upper opening 2 of the nozzle tube 1 has 2-5 different diameters, wherein the different diameters are suitable for connecting said upper opening to a variety of vacuum sources having different diameters.

A further preferred embodiment of the present invention relates to said nozzle, wherein the nozzle further comprises a function monitoring device which indicates of the effect of the power generation device, wherein said function monitoring device comprises an optical indication which indicates the effect of the power generation device, preferably the optical indication is a light source or a display means, preferably the display means in a flat-panel display, preferably LCD display or LED display. The light source may be one or more luminous diodes which light up when the power generation device is producing electricity, most preferably said light source is more than one luminous diode, such as 2-10 diodes, which light up when the power generation device is producing electricity wherein the number of diodes which light up indicate the effect of the power generation device, wherein a low number of lit diodes (e.g. 10-25% diodes lit) indicates low effect, wherein a medium number of lit diodes (e.g. 40-60%) indicate a medium effect and wherein high number of lit diodes (70-85% diodes lit) indicates high effect.

Nozzle according to any one of the previous claims, comprising a function monitoring device which indicates of the effect of the power generation device, wherein said function monitoring device comprises an optical indication which indicates the effect of the power generation device, preferably the optical indication is a light source or a display means, preferably the display means in a flat-panel display, preferably LCD display or LED display.

DETAILED DESCRIPTION

Figure 1:
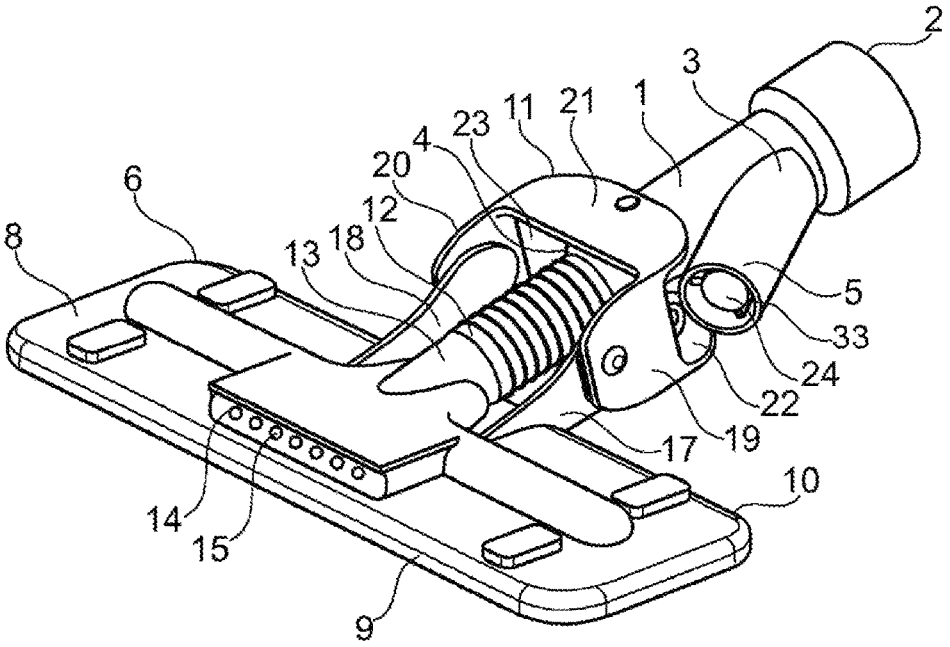
FIG. 1 is a perspective view from the right of a nozzle according to an example of the present invention.
Figure 2:
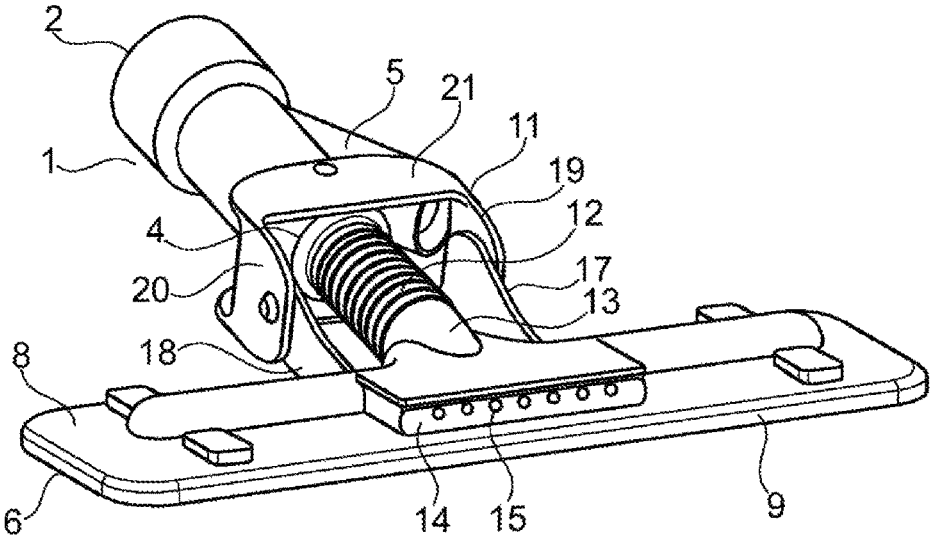
FIG. 2 is a perspective view from the left of the nozzle according to FIG. 1.
Figure 3:
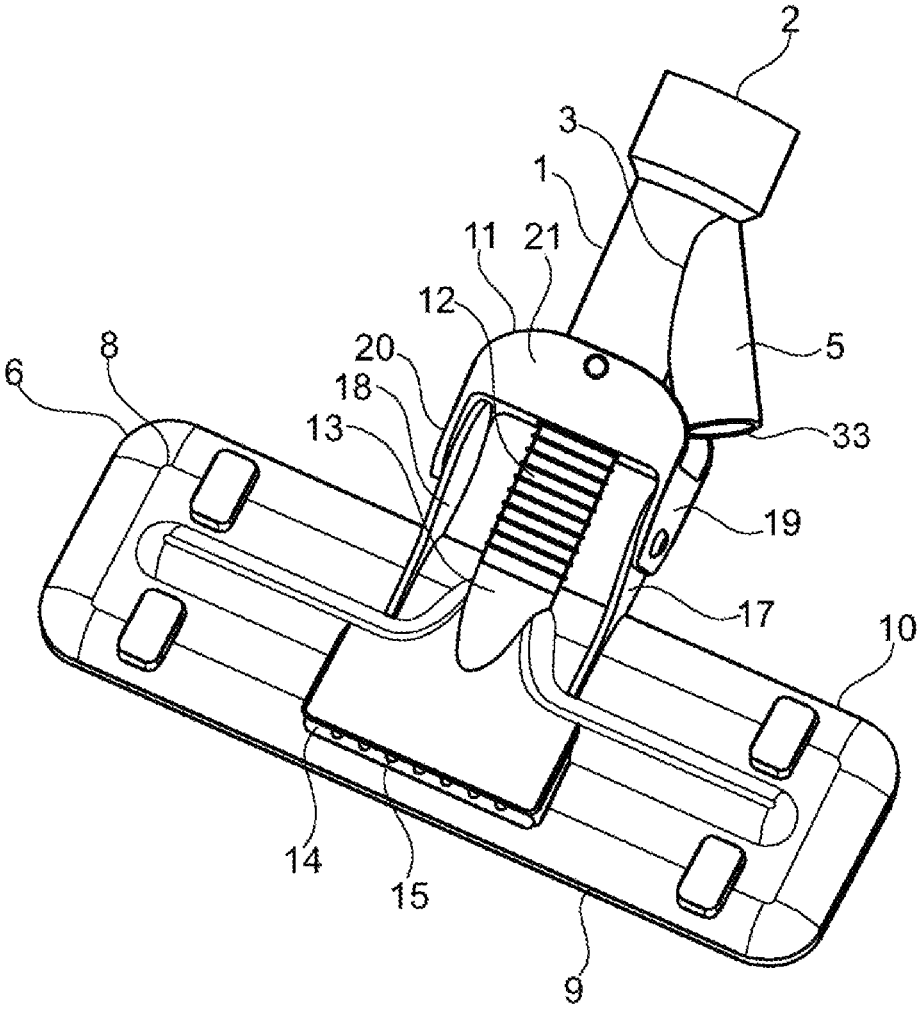
FIG. 3 is a top view of the nozzle according to FIG. 1.
Figure 4:
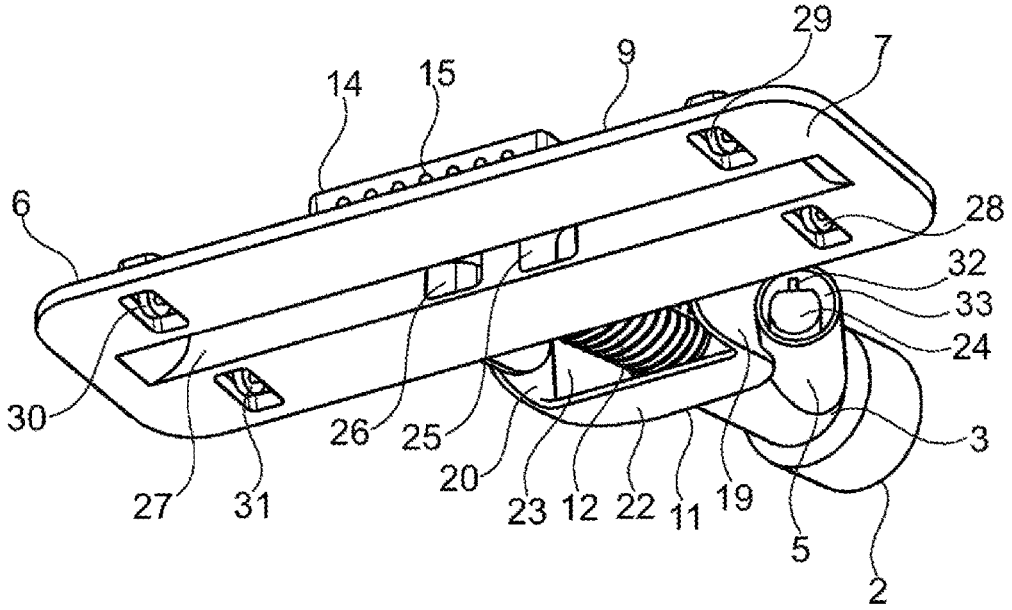
FIG. 4 is a bottom view of a nozzle according to FIG. 1.

There is a complex of problems associated with the nozzles described in prior art documents. Hence, the aim of the present invention is to eliminate said complex of problems.

Referring to FIGS. 1-4, a nozzle according to a specific example of the present invention comprises a nozzle tube 1, a slim nozzle head 6, a flexible joint 11, a flexible conduit 12, a light source 14 and a power generation device 16.

The nozzle tube 1 has an upper opening 2, a side opening 3 and a lower opening 4. The upper opening 2 is configured to be connected to a suction source of a vacuum cleaner. A suction source may be an extension tube (from now on referred to as a tube), pipe union, hose or any other conduit for connecting a nozzle with the vacuum generation unit of a vacuum cleaner. The upper opening 2 of the nozzle tube 1 may be configured as a connection having 2-5 different diameters for being fitted with a variety of suction source tubes having different diameters.

The height of the nozzle head 6 is 9 mm up to 45 mm and the nozzle head can thereby be used for reaching areas in narrow (low) spaces. The expression "slim nozzle head" means that the nozzle head is thin, i.e. the height of the nozzle head is 9 mm to 45 mm. One of the problems with the nozzle in WO2009/078050 is that the nozzle is too high and can't therefore be used for reaching areas in narrow spaces. This problem is solved in the present invention since the nozzle head is slim.

The side opening 3 is attached to an outward projecting tube 5 and the power generation device 16 is mounted in the outward projecting tube 5. In FIGS. 1-4, the outward projecting tube 5 is configured to be on the left side (from the perspective of the operator) of the nozzle tube 1 as well as angled 45 degrees in the direction of the surface of the floor (or a similar surface such as wall or ceiling). However, in other examples of the present invention, the outward projecting tube 5 may be angled in any direction (i.e. angled at a 1-179 degrees in relation to the longitudinal plane of the nozzle tube), as well as be situated on any part of the nozzle tube 1 (i.e. the outward projecting tube is arranged on the nozzle tube 1 at any point in the axial and circumferential directions of the nozzle tube 1). Nevertheless, it is important to configure the angle and position of the outward projecting tube 5 in relation to the nozzle tube 1 so that it does not suck in dust, dirt, soil, dust bunnies, hair, string, thread, lacing, twine, cords and yarn into the power generation device. The outward projection tube 5 may be a cylindrical tube, rectangular tube, quadratic tube or four to ten sided tube.

Figure 5:
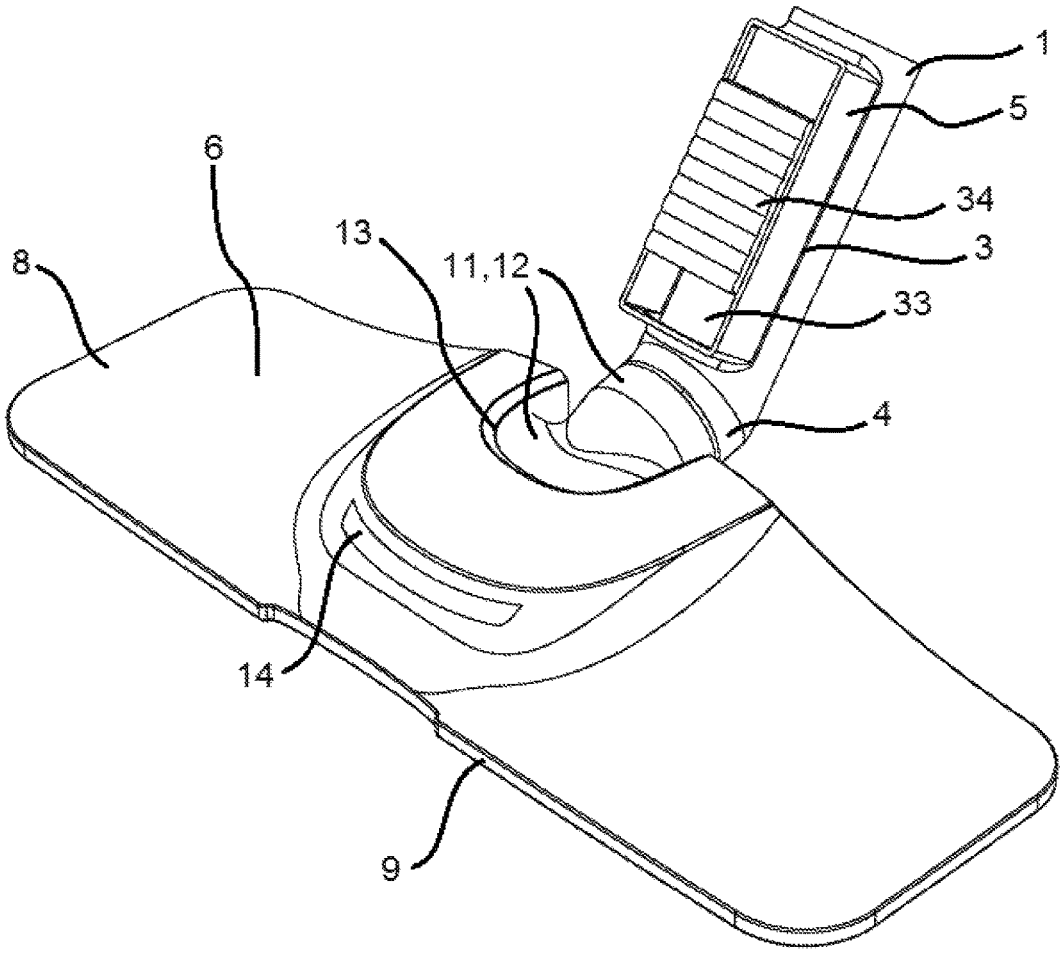
FIG. 5 is a perspective view from the right of a nozzle according to an example of the present invention.

FIG. 5 illustrates an example of the invention in which the side opening 3 is configured to be on the front side (from the perspective of an operator) of the nozzle tube 1. Consequently the outward projecting tube 5 is also configured to be on the front side of the nozzle tube 1. As illustrated in FIG. 5, the outward projecting tube is angled at about 90 degrees (i.e. perpendicular) in relation to the plane of the nozzle tube. Although, the outward projection tube 5 is rectangular in shape in FIG. 5, other tube shapes such as cylindrical tubes, quadratic tubes, as well as four to ten sided tube shapes, may be used as an outward projection tube 5.

The opening 33 of the outward projecting tube 5 may comprise a plate 24 having a diameter smaller than the diameter of the outward projecting tube 5 and being configured to be releasably attached to the outward projecting tube. The plate 24 hinders dust, dirt, soil, dust bunnies, hair, string, thread, lacing, twine, cords and yarn from being sucked into the power generation device. Consequently, the plate 24 hinders the obstruction of the power generation device. In the examples illustrated in figures, the plate 24 is circular, however, in other examples of the invention, the plate 24 may have other geometric forms, as well as being configured to be placed outside of the outward projecting tube 5. The plate may releasably be attached to the outward projecting tube 5 at 1-8 attachment sites 32, preferably at 4 attachment sites. The nozzle of the present invention is constructed so that dust, dirt, soil, dust bunnies, hair, string, thread, lacing, twine, cords and yarn will not obstruct the power generation device. However, in the unlikely situation that obstruction occurs, the plate 24 may be released in order to easily remove dust, dirt, soil, dust bunnies, hair, string, thread, lacing, twine, cords and yarn from the power generation device.

One of the problems with the power generation device disclosed in WO2009/078050 is that dust, dirt, hair, string, lacing, twine, cords and yarn gets tangled and then stuck in the fan. This obstruction lowers the efficiency of electricity generation, as well as leading to complete failure of the fan and total stop of electricity generation. The present invention solve this problem with WO2009/078050 since the nozzle of the present invention is constructed so that dust, dirt, soil, dust bunnies, hair, string, thread, lacing, twine, cords and yarn will not obstruct the power generation device.

The nozzle may further comprise a switch for switching off the power generation device when light illumination is not needed. The switch may be located on any part of the nozzle. The switch may for example be configured to be on the outward projecting tube 5. An example of such a switch 34 is illustrated in FIG. 5 wherein the switch is a plate being configured to slide up or down the opening 33 of the outward projecting tube, alternatively the switch is configured to slide left or right. The switch is substantially parallel to the plane of the nozzle tube 1 and the opening 33 of the outward projection tube 5 is in contact with the switch 34. The switch 34 covers about 25-75% of the opening 33 of the outward projection tube 5. Importantly, the switch is configured so that the operator may slide the switch up, down, right or left to hinder the suction of air into the power generation device thereby switching the power generation device off. In preferred embodiments of the invention, the surface of the switch is covered with a series of parallel riblets extending longitudinally or axially along the surface and have a triangular, elliptical or circular cross-section in the transverse direction. The riblets provide just enough friction so that the operator may easily operate the switch. In FIG. 5, the riblets are extending axially along the surface of the switch plate 34 and have an elliptical cross-section in the transverse direction.

In the specific examples illustrated in the figures, the nozzle head 6 has a rectangular form and comprises an underside 7, topside 8, frontside 9 and backside 10 as well as two shortsides. In the specific examples illustrated in FIGS. 1-3, the frontside and backside (as well as the shortsides) are perpendicular with the plane of the surface of the floor. However, in other examples of the present invention, the frontside and backside (as well as the shortsides) may be substantially perpendicular to the plane of the surface of the floor. The expression substantially perpendicular is meant to indicate in this context that the frontside and the backside have an angle 70-110 degrees relative to the plane of the surface of the floor. Moreover, the frontside and the backside may have rounded forms.

Although the specific examples illustrated in the figures disclose a nozzle head 6 having a rectangular form, the nozzle head may have other forms such as triangular, trapezoidal, parallelogram, quadratic, pentagonal, hexagonal or octagonal.

In the specific examples illustrated in the figures, the underside 7 and topside 8 are parallel with the plane of the surface of the floor. However, in other examples of the present invention, the underside and topside may be substantially parallel with the plane of the surface of the floor. The expression substantially parallel is meant to indicate in this context that the underside 7 and topside 8 have an angle ±20 degrees relative to the plane of the surface. In the example illustrated in FIG. 4, the underside 7 comprises two suction holes 25,26 and a recess 27 which runs from one shortside of the nozzle head to the other short side 6. Moreover, in the same example, there are four wheels 28,29,30,31 configured at the underside of the nozzle head 6. However, in other examples of the present invention, the underside may comprise (a) 1 and 3 or more suction holes, (b) 2 or more recesses, and/or (c) 1, 2, 3 and 5 or more wheels. The recesses may be configured to run from (a) backside to the frontside, (b) shortside to shortside, and/or (c) diagonally. Furthermore, the underside may comprises fabrics, textiles and brushes.

The flexible conduit may be hose or bellow 12 which is connected both to the outlet 13 of the nozzle head 6 and the lower opening 4 of the nozzle tube 1. The hose or the bellow may be made of rubber or any other flexible material. The outlet 13 may extend from the back side 10 of the nozzle head 6. The outlet 13 may be substantially perpendicular to the plane of the backside 10 of the nozzle head 6. Moreover, the outlet in FIGS. 1-4 have an angle of about 15-20 degrees relative to the plane of the surface of the floor. However, in other examples of the present invention, the outlet 13 may have an angle of −10 to 100 degrees relative to the plane of the surface, preferably 0-45 degrees, more preferably 0-20 degrees, even more preferably 0-15 degrees.

The back side 10 of the nozzle head 6 further comprises two flanges 17,18 extending from the back side 10 of the nozzle head 6. The outlet 13 is placed in between the flanges 17,18, and the flexible joint 11 is connected to the flanges. In FIGS. 1-4, the flanges 17,18 are perpendicular to the plane of the backside 10 of the nozzle head 6. Moreover, the flanges 17,18 in FIGS. 1-4 have an angle of about 15-20 degrees relative to the plane of the surface of the floor. However, in other examples of the present invention, the flanges 17,18 may have an angle of −10 to 100 degrees relative to the plane of the surface, preferably 0-45 degrees, more preferably 0-20 degrees, even more preferably 0-15 degrees. Moreover, in further examples of the present invention, the flanges may be substantially perpendicular with the plane off the backside of the nozzle head 6. The expression substantially perpendicular is meant to indicate in this context that that the flanges have an angle 70-110 degrees relative to the plane of the backside of the nozzle head 6.

In FIGS. 1-4, the flanges 17,18 are permanently attached to the nozzle head 6. However, in other examples of the invention the flanges 17,18 may be releasably attached to the nozzle head. Furthermore, the flanges may be pivotably attached to the nozzle head.

The flexible joint 11 is connected both to the nozzle head 6 and the lower opening 4 of the nozzle tube 3. The flexible joint 11 is configured to provide a freedom of movement. The freedom of movement is a movement in the direction of (a) upwards, (b) downwards, (c) leftwards, (d) rightwards, and (e) upwards or downward in combination with leftwards or rightwards. The flexible joint provides a varied and ergonomical vacuum cleaning experience. Hence, the present invention maximizes vacuum cleaning productivity by reducing operator fatigue and discomfort. Furthermore, the present invention minimizes the risk of repetitive strain injury (RSI) as well as injuries to the operator's joints and muscles.

The flexible joint 11 comprises two arms 19,20 which are connected to each other by two connectors 21,22 which are also part of the flexible joint 11. The plane of the arms 19,20 is perpendicular to the plane of the connectors 19,20. The flexible joint 11 further comprises an aperture 23 which is configured for allowing the flexible conduit 12 to extend through the flexible joint 11.

The arms 19,20 of the flexible joint are pivotably connected to the flanges 17,18. The arms 19,20 are parallel with the flanges 17,18, and moreover, the pivotable connection between the arms 19,20 and flanges 17,18 provides a rotational axis ranging from (a) upwards to downwards, as well as (b) downwards to upwards. Consequently, a freedom of movement in the direction of (i) upwards and (ii) downwards is provided. The arms 19,20 may be connected to the flanges 17,18 via pins or plugs. The pins and plugs may are preferably releasably attached, and furthermore, may be secured by caps or seals.

Moreover, the two connectors 21,22 are pivotably connected to two holes at the proximity of the lower opening 4 of the nozzle tube 1. The pivotable connection between the connectors 21,22 and the two holes of the lower opening 4 provides a rotational axis ranging from (i) rightwards to leftwards, as well as (ii) leftwards to rightwards. Hence, a freedom of movement in the direction of (iii) leftwards and (iv) rightwards. The connectors 21,22 may be connected to the two holes in the lower opening 4 via pins or plugs. The pins and plugs may are preferably releasably attached, and furthermore, may be secured by caps or seals. The holes in the lower opening 4 are situated at the top and bottom part of the nozzle tube 1 and the plane of each of the two holes is substantially parallel with the plane of the respective connectors.

Hence, the two pivotably connections described above together provide a freedom of movement in the following directions including (i) upwards, (ii) downwards, (iii) leftwards, (iv) rightwards, and (v) upwards or downward in combination with leftwards or rightwards.

In an alternative embodiment of the invention illustrated in FIG. 5, the flexible joint 11 and the conduit 12 are integrated with each other (i.e. they form one part) and the integrated flexible joint and conduit 11, 12 is connected to both to the nozzle head 6 and the lower opening 4 of the nozzle tube 3. The integrated flexible joint and conduit 11, 12 is configured to be pivotally connected to the nozzle head 6 wherein this pivotal connection provides a pivotal freedom of movement in the (i) upwards and (ii) downwards directions relative to the nozzle head. In this embodiment of the invention, the arms of the flexible joint are inside of the nozzle head 6 and said arms are pivotably connected to an arrangement (e.g. flanges) inside of the nozzle head.

The integrated flexible joint and conduit illustrated in FIG. 5 is also configured to be pivotally connected to the lower opening 4 of the nozzle tube 3 wherein this pivotal connection provides a pivotal freedom of movement in the (iii) leftwards and (iv) rightwards directions relative to the nozzle head. Hence, the two pivotably connections illustrated in FIG. 5 provide a freedom of movement in the directions of (i) upwards, (ii) downwards, (iii) leftwards, (iv) rightwards, and (v) upwards or downward in combination with leftwards or rightwards.

One of the problems with the nozzle in WO2009/078050 is that the freedom of rotation of the nozzle relative to the pipe union is restricted. Thus the problem with the joint in WO2009/078050 is that the pipe union can't be moved upwards and downwards relative to the nozzle which consequentially makes it difficult to angle the nozzle so that one can reach areas in narrow spaces such as underneath couches, sofas and beds. Moreover, the nozzle can't be angled leftwards and rightwards, instead the elbow joint provides a circular movement of the pipe union which has to be followed by the operator pushing the nozzle leftwards or rightwards. This is not an effective vacuum cleaning method since it takes effort and time for the operator to do this circular rotation. Moreover, the operator has to use muscle strength and body movement to sweep the nozzle left and right underneath beds (and other narrow/low areas) which is not ergonomical. The flexible joint according to the present invention solves the problems with the joint disclosed in WO2009/078050 since the flexible joint of the present invention provides a much bigger freedom of movement since the joint can be moved in the directions of (i) upwards, (ii) downwards, (iii) leftwards, (iv) rightwards, and (v) upwards or downward in combination with leftwards or rightwards. Consequently, the flexible joint in the present invention provides an ergonomical working experience for the operator and thereby eliminating discomfort and fatigue. Moreover, for operators who work as professional vacuum cleaning operators, the system disclosed in the present invention provides elimination of repetitive strain injury (RSI) as well as elimination of injuries to the operator's joints and muscles.

The light source 14 has one or more lamps 15 positioned on the nozzle head 6 configured to project light to illuminate the surface to be cleaned. In the examples illustrated in the figures, the light source is placed at the proximity of the frontside. However, in other example the light source may be placed in the proximity of the shortsides and/or the backside. The placement of the light source on the nozzle head eliminates the need of placing a light source placed on a tube connected to the nozzle. A light source placed on a tube (pipe union) connected to a nozzle head would provide light of less intensity due to the distance to the surface to be cleaned (in the proximity of the nozzle head). More importantly, a light source placed on a tube (pipe union) would not illuminate the surface to be cleaned (in the proximity of the nozzle head) when cleaning a surface in low (narrow) spaces. Hence, the present invention provides illumination of the surface to be cleaned as well as illumination with higher intensity of light.

The term lamp is in the present invention a replaceable component that produces light from electricity. A lamp usually has a base made of ceramic, metal, glass or plastic, which secures the lamp in the socket of a light fixture. The electrical connection to the socket may be made with a screw-thread base, two metal pins, two metal caps or a bayonet cap. The types of lamps according to the present invention are selected from the group comprising incandescent lamps (e.g. halogen lamp), light emitting diode (LED) lamps, arc lamps and gas-discharge lamp (e.g. fluorescent lamp). The light source 14 in the figures comprises seven LED lamps 15. However, in other examples of the present invention, the light source may have 1-100 lamps, preferably distributed at the proximity of the frontside, backside and/or shortsides. The light source in the examples produces visible light in the range of 400-700 nanometers. However, in other examples of the present invention, the light source may be in the ultraviolet range.

The power generation device 16 is configured to generate electrical current from the sucked air flow. The power generation device 16 is electrically connected to the light source 14 by an electrical wire and thereby the light source 14 is powered by the electrical current generated by the power generation device 16. The power generation device 16 may comprises a power generator and fan blades attached to the power generator. The placement of the power generation device 16 in the nozzle head eliminates the need of connecting the light source 14 to the power supply of the vacuum cleaner. Hence, the present invention eliminates complicated and expensive manufacturing process of drawing electrical wire to the light source from the power supply of the vacuum cleaner and through tubes (pipes).

The nozzle may further comprise a function monitoring device which indicates of the effect of the power generation device. The function monitoring device comprises an optical indication which indicates the effect of the power generation device. The optical indication may be a light source or a display means. The display means in preferably a flat-panel display such as a LCD display or LED display. The light source may be one or more luminous diodes which light up when the power generation device is producing electricity. The light source is preferably more than one luminous diode, such as 2-10 diodes, which light up when the power generation device is producing electricity. The number of diodes which light up indicate the effect of the power generation device, wherein a low number of lit diodes (e.g. 10-25% diodes lit) indicates low effect, wherein a medium number of lit diodes (e.g. 40-60%) indicate a medium effect and wherein high number of lit diodes (70-85% diodes lit) indicates high effect. In analogy, the flat-panel display such as a LCD display or LED display may indicate the effect in a similar way or show digits or text which are indicative of the effect One of the problems with WO2009/078050 is that it is not possible to disconnect the nozzle in WO2009/078050 from the pipe union in order to connect it to another pipe union, i.e. the nozzle is permanently attached to the pipe union. Consequently, the nozzle in WO2009/078050 is not releasably connected to the tube (pipe union). This problem is solved in the present invention by configuring the nozzle so that it is suitable for being releasably connected to the tube (pipe union). The term releasably connected/attached (or releasable connection/attachment) means that the joining of the nozzle to a tube (pipe union, hose etc.) in the present invention is in such a way as to permit the nozzle and tube to be taken apart and put together without damage to the parts. The basic types of releasable connections in the art are screw and bolted connections, spline joints, connections employing keys and pins, and clamp joints. Some heavy-drive fits and bonded joints that permit disassembly without damage to the parts, for example, by heating, can also be classed as releasable connections.

Moreover, the flanges and/or arms may comprise a mechanism which is activated by the operator, and which after activation holds the nozzle tube at angle 45 to 135 degrees in relation to the plane of the surface of the floor, wherein said activation is preferably made after finishing the operation of the vacuum cleaner.

In an alternative embodiment of the invention, the side opening and the outward projecting tube are arranged on the topside of the nozzle head instead of being arranged on the nozzle tube. Hence, the features of this alternative embodiment differs only from the above exemplified embodiments in that the side opening and the outward projecting tube are arranged on the topside of the nozzle head. All of the other features are the same as the above disclosed preferred embodiments.

The invention claimed is:

1. A nozzle suitable for being releasably connected to a suction source of a vacuum cleaner, comprising:

a nozzle tube having an upper opening, and a lower opening, the upper opening being configured to be connected to a suction source of a vacuum cleaner, a side opening being attached to an outward projecting tube, wherein the side opening and the outward projecting tube are arranged on the nozzle tube, a slim nozzle head, wherein the height of the nozzle head is 9 mm up to 45 mm, and wherein the nozzle head has an underside, topside, frontside and backside, a flexible joint connected both to the nozzle head and the lower opening of the nozzle tube, wherein the flexible joint is configured to provide a freedom of movement, wherein said freedom of movement is a movement in the direction of (i) upwards, (ii) downwards, (iii) leftwards, (iv) rightwards, and (v) upwards or downwards in combination with leftwards or rightwards, a conduit connected both to the outlet of the nozzle head and the lower opening of the nozzle tube, a light source having one or more lamps positioned on the nozzle head and configured to project light to illuminate the surface to be cleaned, and a power generation device mounted in the outward projecting tube, the power generation device being configured to generate electrical current from the sucked air flow, the power generation device being electrically connected with the light source by an electrical wire, and the light source being powered by the electrical current generated by the power generation device.

2. The nozzle according to claim 1, wherein the side opening, and the outward projecting tube are arranged on the nozzle tube, preferably the side opening, and the outward projecting tube are arranged at any point in the axial and circumferential directions of the nozzle tube.

3. The nozzle according to claim 1, wherein the side opening, and the outward projecting tube are arranged on the front side of the nozzle tube, preferably the side opening and the outward projecting tube are arranged centrally on the nozzle tube.

4. The nozzle according to claim 1, wherein the flexible joint and the conduit are integrated with each other and thus forming one part, wherein the integrated flexible joint and conduit is connected to both to the nozzle head and the lower opening of the nozzle tube, wherein the integrated flexible joint and conduit is configured to be pivotally connected to the nozzle head and providing a pivotal freedom of movement in the (i) up-wards and (ii) downwards directions relative to the nozzle head, wherein the flexible joint and conduit is also configured to be pivotally connected to the lower opening of the nozzle tube and providing a pivotal freedom of movement in the (iii) leftwards and (iv) rightwards directions relative to the nozzle head.

5. The nozzle according to claim 1, wherein the conduit is preferably flexible, more preferably the conduit is a hose or a bellow.

6. The nozzle according to claim 1, wherein the outlet extends from the backside of the nozzle head, wherein the outlet is substantially perpendicular to the plane of the backside of the nozzle head, wherein the outlet has an angle of −10 to 100 degrees relative to the plane of the surface, preferably 0-45 degrees, more preferably 0-20 degrees, even more preferably 0-15 degrees.

7. The nozzle according to claim 1, wherein the back side of the nozzle head further comprises two flanges extending from the backside of the nozzle head, the outlet being placed in between the flanges, and wherein the flexible joint is connected to the flanges, wherein the flanges are substantially perpendicular to the plane of the backside of the nozzle head, wherein the flanges have an angle of −10 to 100 degrees relative to the plane of the surface, and wherein the flexible joint comprises two arms connected to each other by two connectors which are also part of the flexible joint, the flexible joint further comprising an aperture configured for allowing the flexible conduit to extend through the flexible joint, and the arms of the flexible joint being pivotably connected to the flanges, the two connectors being pivotably connected to the lower opening of the nozzle tube.

8. The nozzle according to claim 1, wherein the outward projecting tube is angled 1-179 degrees in relation to the plane of the nozzle tube.

9. Nozzle according to claim 1, wherein the outward projecting tube is angled 1-179 degrees in relation to the plane of the topside of the nozzle head.

10. The nozzle according to claim 1, wherein the outward projecting tube is configured to be on a front side of the nozzle tube, and preferably angled at about 90 degrees in relation to the plane of the nozzle tube.

11. The nozzle according to claim 1, wherein the outward projecting tube is configured to be centrally on the front side of the nozzle tube, and preferably angled at about 90 degrees in relation to the plane of the nozzle tube.

12. The nozzle according to claim 1, comprising a switch for switching off the power generation device, preferably the surface of the switch is covered with a series of parallel riblets extending longitudinally or axially along the surface of the switch, wherein the riblets have a triangular, rectangular, elliptical or circular cross-section in the transverse direction.

13. The nozzle according to claim 1, comprising a switch for switching off the power generation device, said switch being a plate configured to slide up or down the opening of the outward projecting tube, alternatively configured to slide left or right, said switch being substantially parallel to the plane of the nozzle tube, wherein the opening of the outward projection tube is preferably in contact with the switch, the switch partially covering the opening of the outward projection tube, wherein the switch is configured so that the operator may slide the switch up, down, right or left to hinder the suction of air into the power generation device thereby switching the power generation device off.

14. The nozzle according to claims 1, wherein the opening of the outward projecting tube comprises a plate being smaller than the opening of the outward projecting tube and being configured to be releasably attached to the outward projecting tube, the opening of the outward projecting tube is circular and comprises a plate having a diameter smaller than the diameter of the outward projecting tube and being configured to be releasably attached to the outward projecting tube.

15. The nozzle according to claim 1, wherein the underside of the nozzle head comprises one or more suctions holes one or more recesses and one or more wheels at the underside of the nozzle head.

16. The nozzle according to claim 1, wherein the upper opening of the nozzle tube has 2-5 different diameters, wherein the different diameters are suitable for connecting said upper opening to a variety of vacuum sources having different diameters.

17. The nozzle according to claim 1, comprising a function monitoring device which indicates the effect of the power generation device, wherein said function monitoring device comprises an optical indication which indicates the effect of the power generation device, the optical indication is a light source or a display means.

18. The nozzle according to claim 17, wherein the light source of the optical indication is one or more luminous diodes which light up when the power generation device is producing electricity, such that the number of diodes which light up indicate the effect of the power generation device.

* * * * *